US011153684B2

(12) United States Patent
Polleros et al.

(10) Patent No.: US 11,153,684 B2
(45) Date of Patent: Oct. 19, 2021

(54) DYNAMIC DEBUZZER FOR SPEAKERS

(71) Applicant: Maxim Integrated Products, Inc., San Jose, CA (US)

(72) Inventors: Robert Polleros, Sunnyvale, CA (US); Vivek Prakash Nigam, Dublin, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 0 days.

(21) Appl. No.: 16/670,793

(22) Filed: Oct. 31, 2019

(65) Prior Publication Data

US 2020/0162818 A1 May 21, 2020

Related U.S. Application Data

(60) Provisional application No. 62/767,953, filed on Nov. 15, 2018.

(51) Int. Cl.

| | |
|---|---|
| ***H04R 3/04*** | (2006.01) |
| ***G10L 25/18*** | (2013.01) |
| ***H04R 1/28*** | (2006.01) |
| ***H04R 1/02*** | (2006.01) |

(52) U.S. Cl.
CPC ..... *H04R 3/04* (2013.01); *G10L 25/18* (2013.01); *H04R 1/025* (2013.01); *H04R 1/2826* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,696,357 | A * | 12/1997 | Starobin | H04R 1/2819 181/156 |
| 9,615,163 | B1 * | 4/2017 | Nachman | H04R 1/2826 |
| 9,818,394 | B2 * | 11/2017 | Fuller | G10K 11/17817 |
| 10,225,654 | B1 * | 3/2019 | Lindemann | H04R 3/007 |
| 2004/0203494 | A1 * | 10/2004 | Eaton | H04R 1/2842 455/90.1 |
| 2008/0152168 | A1 | 6/2008 | Magrath | |
| 2011/0142255 | A1 | 6/2011 | Tanaka | |
| 2014/0341394 | A1 * | 11/2014 | Croft, III | H04R 3/04 381/102 |
| 2016/0052246 | A1 * | 2/2016 | Egger | C09J 7/25 381/426 |
| 2016/0212546 | A1 * | 7/2016 | Salvatti | H04R 9/06 |

(Continued)

*Primary Examiner* — Duc Nguyen
*Assistant Examiner* — Assad Mohammed
(74) *Attorney, Agent, or Firm* — Lowenstein Sandler LLP

(57) ABSTRACT

The implementations describe a method and a system to perform the method to reduce buzzing in a speaker by obtaining a signal having an audio content, determining a first value of spectral density of the audio content at a first resonance frequency, the first resonance frequency associated with a mechanical motion of at least one member of a speaker assembly, determining a second value of spectral density of the audio content at a second resonance frequency, the second resonance frequency associated with a port of the speaker assembly, determining, responsive to the first value and the second value, that the signal is to produce buzzing of the speaker at the second resonance frequency, producing a modified signal by limiting spectral density of the audio content at the first resonance frequency, and providing the modified signal to the speaker.

20 Claims, 9 Drawing Sheets

(56) References Cited

U.S. PATENT DOCUMENTS

| | | | | |
|---|---|---|---|---|
| 2016/0260423 | A1* | 9/2016 | Rosenkranz | H04R 25/453 |
| 2017/0111737 | A1* | 4/2017 | Painter | H04R 3/007 |
| 2017/0188135 | A1* | 6/2017 | Lage | H04R 1/2826 |
| 2018/0115824 | A1 | 4/2018 | Cassidy et al. | |
| 2018/0122401 | A1* | 5/2018 | Iyer | G10L 21/0264 |
| 2018/0220233 | A1* | 8/2018 | Napoli | H04R 3/007 |
| 2019/0364357 | A1* | 11/2019 | Haastrup | G10L 21/0264 |

* cited by examiner

DYNAMIC DEBUZZER FOR SPEAKERS

RELATED APPLICATIONS

This application claims priority under 35 U.S.C. 119(e) from U.S. Provisional Application No. 62/767,953 filed 15 Nov. 2018, which application is incorporated herein in its entirety.

TECHNICAL FIELD

This instant specification generally relates to improvements of speaker quality by reducing or suppressing buzzing of the speakers during playback of an audio content. More specifically, the instant specification relates to identifying mechanical and acoustic resonances responsible for production and amplification of buzzing and limiting audio content causing such resonances.

BACKGROUND

Modern hand-held electronic devices, such as smartphones and tablet computers require sound playback capabilities that can meet increasing customer expectations regarding quality of the sound. But the restrictions imposed by the small size of the speakers—that need to be fit inside the hand-held devices—make achieving significant improvements in the performance of such speakers rather challenging. In particular, speakers are prone to buzzing when an audio content of the playback has a large volume. The buzzing sound may have an annoying tone within the 5-10 kHz frequency range, depending on the size and design of the speakers. The presence of such buzzing significantly decreases enjoyment of the audio content by the user and detracts from the overall experience of the user. Some causes of the buzzing may have electric circuit origin. For example, buzzing may be caused by spurious currents induced due to the ground loop effect where the speaker shares the same ground with another device on the same or different circuit. But other causes of the buzzing may be intrinsic to the design of the speakers. Eliminating or at least reducing buzzing may then require identifying the root causes of the buzzing and addressing them in a way that affects audio content as little as possible.

DESCRIPTION OF DRAWINGS

Aspects and implementations of the present disclosure will be understood more fully from the detailed description given below and from the accompanying drawings of various aspects and implementations of the disclosure, which, however, should not be taken to limit the disclosure to the specific aspects or implementations, but are presented for explanation and understanding purposes only.

DETAILED DESCRIPTION

The modern smartphone technology utilizes speakers whose small dimensions make achieving high quality sound performance rather challenging. In particular, spurious noise—buzzing or audio distortions—can often be heard during playback. This buzzing sound is the result of a complicated interaction of various mechanical resonances present in the speaker assembly. Such resonances may be hard to avoid since a relatively small speaker assembly box needs to produce a high volume of sound. A typical smartphone speaker design may comprise a side-firing speaker box having an opening—a port for the sound to escape from the box. In some implementations, the speaker is a side-firing speaker disposed on an adjacent side of the side with the port. A port may be a narrow slot whose length exceeds its width. Such a port may have its own acoustic resonance which may amplify the sound signal as the sound escapes through the port. This acoustic port resonance may occur at such frequency where the wavelength of sound is comparable with the dimensions of the port. For example, a narrow port of length $l \approx 1$ in, a design common in modern smartphones, can be expected to resonate at such frequency for which half the wavelength of the sound fits within the port's length, i.e. at $f_p = u/2l$, where $u = 340$ m/s is the speed of sound. For the port length $l \approx 1$ in this provides the estimate of the port resonance frequency of $f_p \approx 7$ kHz. Because various other designs of speaker box ports are available with different resonance frequencies, one should understand this number as an illustration only. For example, in some implementations, the length (or width) of the port may corresponds to a full wavelength of sound, one and a half wavelength of sound, or any integer number of half-wavelengths of sound. In some implementations, the port may have a non-rectangular shape (e.g., a circular shape), and the port resonance(s) may be determined as solutions of sound wave dynamics for the corresponding apertures. For various designs the port resonance can be anywhere within the 5-10 kHz frequency range, or even outside this range. The existence of the port resonance may be a technical nuisance in some instances or a feature that may be advantageous for high-frequency tones in others implementations.

Figure 1:
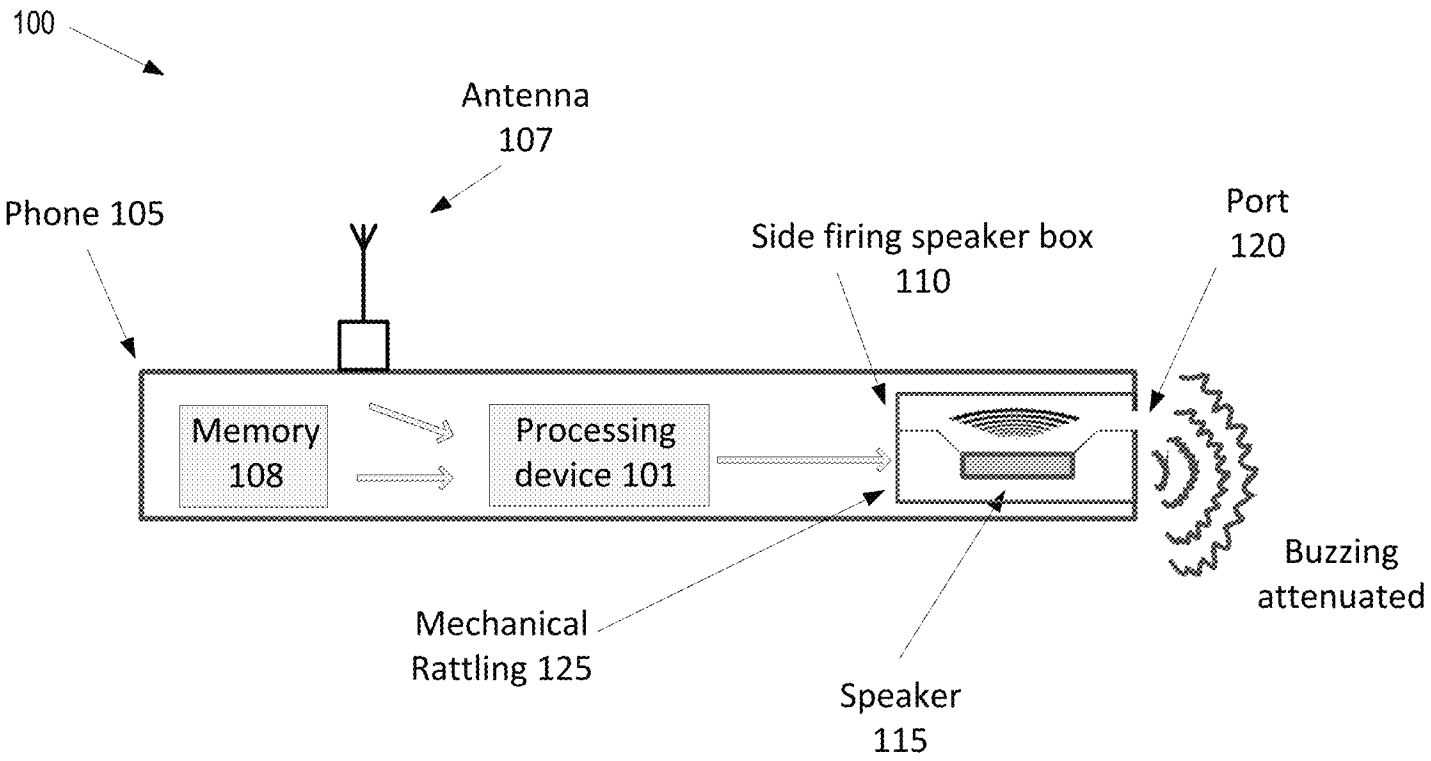
FIG. 1 depicts a schematic diagram that shows a speaker mounted inside a side-firing speaker box that in turn is located inside a larger device, such as a smartphone, and a processing device to implement debuzzing, according to one embodiment.

FIG. 1 illustrates, by way of example, a possible design 100 of a speaker assembly incorporated into a device 105, such as a smartphone, according to one implementation. A speaker box 110 may comprise a cavity which houses a speaker 115. A port 120 may connect the cavity of the speaker box 110 with the outside space. The design of the port 120 may be such that the port has one or more resonances. The specific design illustrated in FIG. 1 is known as the side-firing speaker, but multiple other designs are also possible, such as front-firing speakers, bottom-firing speakers, top-firing speakers, etc. In some implementations, the speaker may be a microspeaker, e.g., a speaker whose sound-producing membrane (cone, etc.) has a perimeter (e.g., an outer perimeter) of less than 5 inches (or less than 3 inches, in other implementations), such as a speaker inside a smartphone, a tablet, and so on.

In the following, for the ease of description and not by way of limitation, it will be assumed that there is one port resonance at frequency $f_p$. It should be understood, however, that the same inventive concepts and solutions may be applied in a situation of multiple port resonances.

The port resonance may be characterized by its quality factor $Q_p$. The port resonance may more or less efficiently—depending on the quality factor—amplify sound, such as music or voice, produced by the speaker 115 and escaping through the port 120. The emitted sound may, in general, happen to contain frequencies within the width (full width at the half maximum) of the port resonance $\Delta f_p = f_p/Q_p$. Unfortunately, the port resonance may amplify not only the "good" signal intended for playback, such as music, voice, or any other intended signal, but may also enhance any undesired sound that may be generated inside the speaker box 110. For example, the speaker 115 may utilize a mechanical diaphragm or membrane (not illustrated in FIG. 1) to produce sound, but the mechanical membrane may also generate spurious buzzing sound at low frequencies, for example near 1 kHz frequency or any other frequency, depending on the design of the diaphragm. The buzzing may be generated due to imperfections of the diaphragm or from a mechanical support of the diaphragm in the speaker 115. Because conversion of electric signal into sound waves requires that the diaphragm of the speaker 115 is movable, complete elimination of the buzzing may be impossible. Additionally, the buzzing may not come directly from the diaphragm but be produced by any other component or a member of the speaker assembly, such as the speaker box 110, or of the device 105. For example, the buzzing may originate from mechanical rattling 125 of the speaker box 110; e.g., from relative motion of various components, such as walls, of the speaker box 110. Alternatively, rattling may be associated with how the speaker box 110 is attached to the device 105. Because virtually any mechanical connection can suffer from at least some amount of rattling, the sources of buzzing in a speaker assembly can be numerous. Even a small amount of buzzing/rattling can be amplified by the port resonance and negatively affect user's experience.

FIG. 1 illustrates basics of how the inventive solution may be implemented in one possible embodiment. A signal (illustrated with the arrow) may be obtained from a radio antenna 107. The signal may have an audio content, which may be encoded as a low-frequency modulation of a high-frequency electromagnetic signal received by antenna, in one implementation. Alternatively, the signal may be read from a memory 108 or obtained through a network connection or a Wi-Fi connection (not shown explicitly). The memory 108 may be a cloud storage, in one implementation. The signal may be provided to a processing device 101 where the signal may be amplified, equalized, and filtered to modify the signal's spectral content. The spectral content may be modified in such a way (see the discussion below) that minimizes buzzing induced by the mechanical rattling 125 which is subsequently amplified by the port 120. The processing device 101 may be purely analog or digital or a combination of analog and digital components. After modifying the signal, the processing device 101 may provide the modified signal to the speaker 115.

Figure 2A:
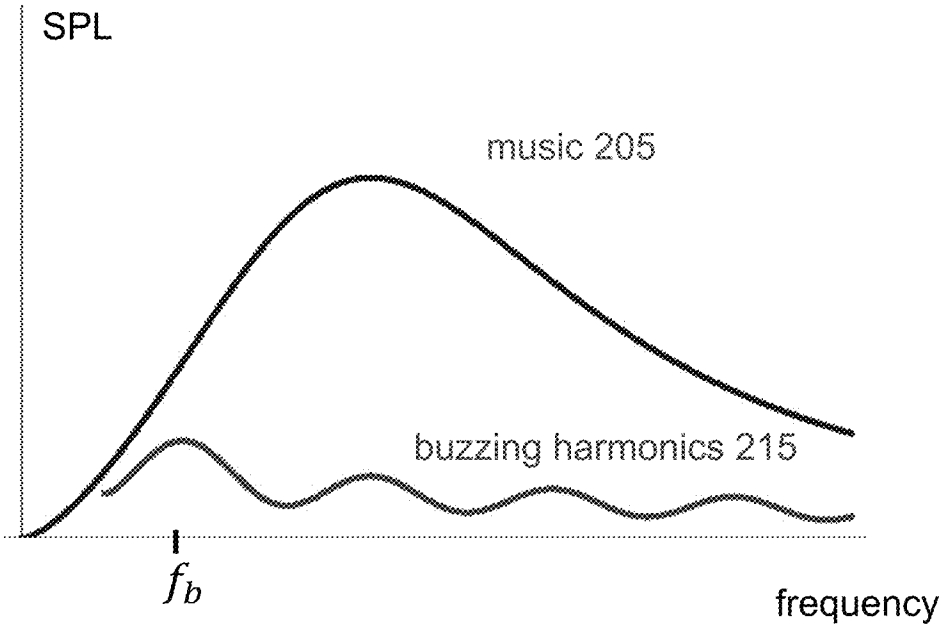
FIG. 2*a* schematically illustrates the origin of buzzing identified in this disclosure where an audio content (e.g. music) induces a mechanical rattling (box) resonance causing buzzing harmonics at progressively higher frequencies according to one implementation.

FIG. 2*a* illustrates one possibility of how buzzing/rattling can affect sound quality, according to one implementation. The upper curve illustrates a possible dependence of the amplitude of the music signal 205 on frequency. Playback may refer to any music, speech, voice, or any other signal audible to a human ear and the term "music" is intended to include all such possible meanings. The horizontal axis indicates the frequency of the sound and the vertical axis shows sound pressure level (SPL) of the music signal generated by the speaker 115. The dependence of SPL on frequency can be understood as the spectral (e.g. Fourier) expansion of the signal over frequencies with the value of SPL indicating how strongly the particular frequency is represented in the total sound signal. The spectral distribution of FIG. 2*a* (as well as subsequent FIGS. 2*b-d*) may be understood as a continuous expansion over frequencies (e.g. a Fourier integral) or, alternatively, as an expansion over a discrete set of frequencies (e.g. a Fourier series) with the degree of frequency resolution depending on the particular embodiment. The frequency may be indicated in units of Hz; SPL may be indicated in units of decibels (dB), or some other units. The plots of SPL vs. frequency shown in FIG. 2*a* (as well as subsequent FIGS. 2*b-d*) are to be understood as qualitative illustrations only and not as specific data measured for any particular speaker devices. The music signal 205 may have a broad high amplitude band within the frequencies corresponding to the range of human hearing and may decrease away from that range, at low or high frequencies, or both.

The music signal 205 may be caused by electromagnetically induced mechanical motion of a moving component (e.g. diaphragm or membrane) of the speaker 115. The motion of the moving component may further induce additional motion in the speaker assembly, such as other parts of the speaker 115 and/or the speaker box 110 that encloses the speaker 115, and/or the connection(s) of the speaker box 110 to the outside environment, such as the circuit board, device housing, etc. of the device, such as the device 105 that houses the speaker 115. Alternatively, the mechanical motion in other parts of the speaker 115, speaker box 110, or device 105 may be induced by the modulations of the air pressure caused by the music signal 205 around the speaker 115, inside or outside the speaker box 110, or the device 105. The mechanical motion—mechanical rattling 125—may have a resonance associated with it at some box frequency $f_b$ (the term "box" and the subscript indicating a relation of the resonance to some part of the speaker assembly, e.g. a box). The frequency of this rattling/box resonance can be about 1 kHz. However, depending on the specific embodiment of the speaker 115 and/or the speaker box 110, such as the size of their components, the frequency of the buzzing resonance $f_b$ may be significantly different from 1 kHz, for example it can be anywhere within the 100 Hz-1.5 kHz range or even outside this range. The frequency of the box resonance(s) may depend on the size and elastic properties of the speaker assembly components and the manner in which these components are connected to each other. Additionally, there can be multiple rattling/box resonances existing within a given system and affecting each other in a complicated fashion. As the music signal 205 may extend to frequencies of one or more of the box resonances $f_b$, it may—with a varying degree of efficiency, depending on the frequency $f_b$ of the resonance and its quality factor $Q_b$, which describes the degree to which the resonance is coupled to the environment—induce at least one such resonance, see rattling/box resonance 210 on FIG. 2*a*. Nonlinearities (anharmonicities) present in any realistic mechanical oscillating system may not only induce the main resonance at $f_b$, but may also cause additional buzzing harmonics with different, e.g. higher, frequencies.

Figure 2B:
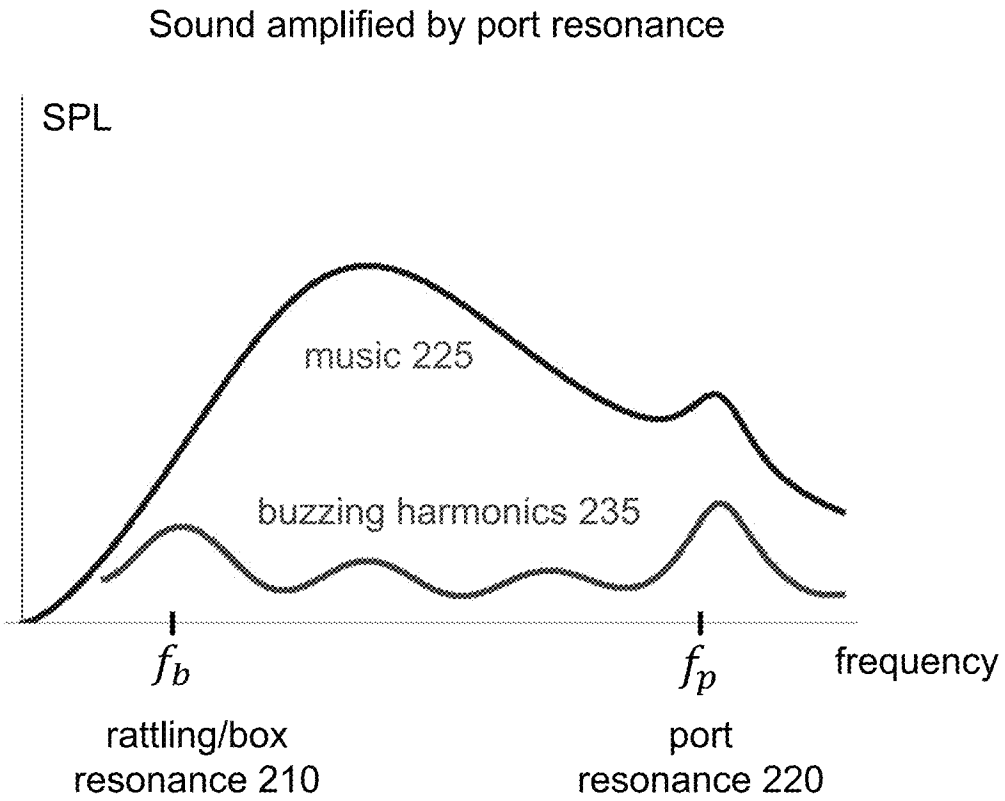
FIG. 2*b* schematically illustrates how both the audio content and the buzzing harmonics may be amplified by an acoustic resonance of the speaker box port, according to one implementation.

The bottom curve illustrates, in qualitative terms, the sound pressure level of buzzing harmonics 215 induced by the music signal 205 through the box resonance 210 and extended to other frequencies/harmonics due to anharmonicities in the oscillations of the source(s) of mechanical rattling. The relative magnitudes of SPL of the music signal 205 and buzzing harmonics 215 are presented for illustration purposes only and may be very different in speakers of different designs, sizes, etc., and operating under different conditions. The illustration of FIG. 2*a* shows maxima of buzzing harmonics located at frequencies roughly multiple of the main buzzing frequency $f_b$, in particular, $2f_b$, $3f_b$, $4f_b$, etc. However, the distribution of buzzing harmonics in specific implementations can be different from that shown on FIG. 2*a*. For example, buzzing harmonics may come from the interaction of multiple main frequencies $f_b$ corresponding to different mechanical rattlings, such as rattling of the speaker diaphragm/membrane, rattling of the speaker 115 inside the speaker box 110, rattling of the speaker box 110 inside the device (e.g. phone) 105, etc. As shown in FIG. 2*b* by way of illustration, buzzing harmonics 215 may extend to frequency(ies) $f_p$ of the port resonance 220 and be amplified by it. FIG. 2*b* illustrates how SPL of both the music signal and the buzzing sound may be amplified by the port resonance, according to one implementation. The music signal 225 may have an amplification maximum at or around $f_p$. Likewise, buzzing harmonics 235 may be resonantly enhanced at or near $f_p$. FIG. 2*b* is meant to highlight the basic features of sound amplification by the port resonance. The magnitude of the signal enhancement in a specific embodiment may differ from that of FIG. 2*b*, which should not be understood as a measurement referring to any particular system. The vertical scales in FIG. 2*b* and FIG. 2*a* could be very different. In particular, FIG. 2*a* may refer to a hypothetical situation where no port resonance is present, for example, where the speaker 115 emits sound waves directly into the outside space rather than into the speaker box 110, or another situation where the port resonance is present but located outside the frequency range of human hearing. On the other hand, SPL on FIG. 2*b* may refer to the actual sound pressure level existing outside the speaker box of a speaker embodiment where the port resonance 220 does, if fact, amplify the emerging sound. The existence of the port resonance 220 may be a design feature intended to improve the sound output and the overall performance of the speaker. The amplification of the music signal 225 may, therefore, be desirable. Unfortunately, the port resonance 220 may non-selectively amplify all sounds existing inside the speaker box 110 and having frequency at or near $f_p$, including the undesired spurious buzzing harmonics shown in FIG. 2*b*. The buzzing amplified by the port resonance can substantially affect the performance of the speaker from the viewpoint of its user and significantly decrease the user's enjoyment of the sound playback. However, eliminating buzzing harmonics with existing techniques may not be feasible. For example, a conventional equalizer may be ineffective because it may only modify the signal before it is provided to the speakers whereas the buzzing originates inside the speaker/speaker box after equalizing.

To address the buzzing at the port resonance frequency $f_p$—namely, to eliminate the buzzing harmonics 235 as much as possible without detrimentally suppressing the music signal 225—it may be more efficient to reduce buzzing by suppressing it at the point of its origin, at or near frequency $f_b$. Specifically, the main rattling/box resonance may occur at a lower frequency $f_b$ and extend to higher frequency, such as $f_p$ in the form of buzzing harmonics 235. Because suppression of the amplitude of the main buzzing oscillations with frequency $f_b$ would also reduce the buzzing harmonics 235, it may be advantageous to first suppress mechanical rattling at $f_b$. In one embodiment, the higher harmonics can have frequencies that are integer frequencies of the main frequency $f_b$ such as $2f_b$, $3f_b$, $4f_b$, etc. As a way of example and not of limitation, the box resonance may be at $f_b$ 1 kHz, and the port resonance may be at $f_p$ 7 kHz. One may further notice that the buzzing harmonics 235 appears in response to the music signal 225, and therefore, reducing the music signal 225 may at least partially eliminate the buzzing harmonics 235.

Figure 2C:
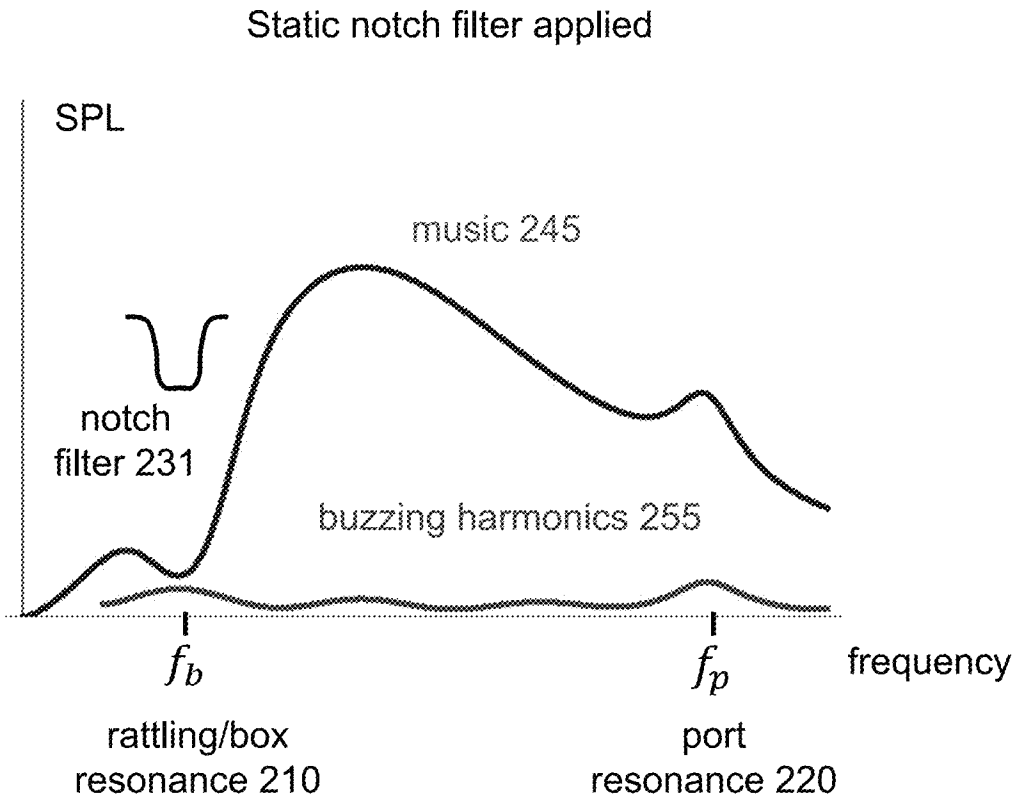
FIG. 2*c* schematically illustrates how limiting the audio content with a static notch filter at or near the box resonance frequency may suppress rattling due to box resonance and reduce the buzzing harmonics, according to one implementation.

In accordance with this understanding, FIG. 2*c* illustrates how buzzing sound at the port frequency $f_p$ can be reduced without affecting the magnitude of the music signal at the same frequency $f_p$, according to one implementation. For example, the music signal can be filtered with a notch filter 231 whose central frequency may be at or near the buzzing resonance frequency $f_b$. A notch filter (band-stop filter, band-rejection filter) is a filter that passes most frequencies unaltered, but attenuates/eliminates frequencies within a specific range. The width of the rejected band of the notch filter 231 can vary depending on the specifics of the buzzing resonance. In some embodiments, the width of the rejected band may be hundreds of Hz or more. In some embodiments, the width of the rejected band can be one semitone or less. In other embodiments, the width of the rejected band may be selected in view of the full width $\Delta f_b = f_b/Q_b$ of the box resonance 210 and can be broader than one full width, about the same as one full width, close to one half of the full width, or be significantly smaller. For example, one may divide the full width $\Delta f_b$ of the buzzing resonance into a number N of frequency intervals of $=\Delta f_b/N$, and configure the notch filter so to reject any number of such intervals. In some embodiments, only one interval $\delta f$ may be rejected. In other embodiments, several intervals may be rejected, including N intervals (one full width of the resonance) or more than N intervals, as may be needed.

The notch filter 231 can modify the music signal 225 at or near the buzzing resonance 210 so that the filtered music signal 245 has SPL notched-out for frequencies close to $f_b$. The music signal 245 may have the frequency components within the rejected band suppressed to a desired degree, depending on the settings or parameters of the notch filter. For example, these frequency components may be suppressed only slightly in some embodiments but eliminated almost completely in other embodiments. Correspondingly, the music signal 245, having a lower spectral density at or near $f_b$ compared with the music signal 225 prior to filtering, will cause reduced—in some instances significantly reduced—mechanical buzzing/rattling at or near the rattling/box frequency $f_b$. The reduced amplitude of the main buzzing resonance may cause the buzzing harmonics 255 with higher frequencies, such as $2f_b$, $3f_b$, $4f_b$, etc., to diminish significantly, as illustrated qualitatively in FIG. 2*c*.

Even though the harmonics at or near the port resonance $f_p$ may still be amplified by the port resonance, this amplification may not be as significant as in the case of the buzzing harmonics 235 produced by the music signal 225 in the absence of filtering. Accordingly, the SPL of the buzzing may be reduced to a significant degree, in some instances to below the level where it could be detected by the user.

This improved performance of the speaker near the port frequency $f_p$ may, however, come with a disadvantage at low frequencies close to the box resonance frequency $f_b$ where a substantial part of the music signal 245 may now be missing. The missing part of the spectrum may correspond to important tones of the music playback. For example, frequency $f_b$ 1 kHz is close to High C (Soprano C) tone. Complete elimination of such tones may adversely affect the user's enjoyment of the playback.

However, in some situations a complete elimination of the frequencies near $f_b$ may not even be necessary. For example, the intensity of the buzzing sound at or near frequency $f_p$, as subjectively perceived by the user, may be masked if the spectral content of the music signal 245 is sufficiently strong. "Spectral content" may refer to SPL associated with a particular frequency (or an interval of frequencies) of the music signal 245, e.g., a Fourier harmonic of the music signal 245. For example, the acoustic energy of the music content output by the speaker—the masking energy—may dominate the acoustic energy of the buzzing. Under such conditions, the user may not be able to detect the presence of the buzzing harmonics 235 on top of a sufficiently strong playback signal. Under such conditions, the benefit provided by the notch filter at higher frequencies≈$f_p$ may be insignificant and in fact outweighed by the distortion of the music signal at lower frequencies≈$f_b$. This demonstrate that although in some situations the notch filter that is always on—the static notch filter—is beneficial, in other situations such continuous filtering may be uncalled for.

In some embodiments, a dynamic notch filter (adaptive notch filter), i.e. a filter that is turned on and off selectively, depending on the instantaneous spectral content of the music signal, may provide a superior performance and a better overall user experience. For example, a spectrum analyzer may perform analysis of the music content input to the speaker and determine whether the music content near the port resonance $f_p$ is sufficiently strong to mask the buzzing harmonics produced 255 by the speaker/speaker box and amplified by the port resonance 220. In those instances where the spectrum analyzer data indicate that the music content near the port resonance $f_p$ is insufficient to mask the buzzing, the notch filter can be turned on. In contrast, in those instances where the spectrum analyzer data indicate that the music content near the port resonance $f_p$ is strong enough to ensure that the user would be unlikely to discern buzzing harmonics 255, the notch filter may not be activated.

In some embodiments, depending on the music content, a dynamic filter may always be in one of the two states: (1) fully on-state, and (2) fully off-state. In the off-state, no band rejection would occur while in the on-state the notch filter would be fully activated. The music signal may be continuously monitored and a controller may execute a "notch filter on/off decision" as to which of the two states of the dynamic filter is to be selected depending on the instantaneous spectral density of the sound content. The controller can be a software component executed by a processing device of the device 105. Alternatively, the controller may be implemented as a separate hardware component or a combination of hardware and software components.

In some embodiments, the spectral analysis of the music signal may not be performed continuously. Instead, the spectrum analyzer may collect spectral data at the beginning of discrete predetermined time intervals and the controller may execute an on/off decision until the end of the current time interval. The temporal length of such intervals may vary from a small fraction of a second to at least several music tones or be even longer. The length of the time intervals may be a function of how quickly the spectral content of the music signal changes with time. For example, the spectral analysis may be initially set to be performed after every time interval $\tau$, where $\tau$ may represent some predetermined optimal time interval. If the spectrum analyzer detects that the music signal's spectral content varies significantly over time $\tau$, the time interval between two consecutive analyses may be shortened. Conversely, if the spectrum analyzer detects that the music signal's spectral content varies insignificantly over time $\tau$, the interval between two consecutive analyses may be extended.

Figure 2D:
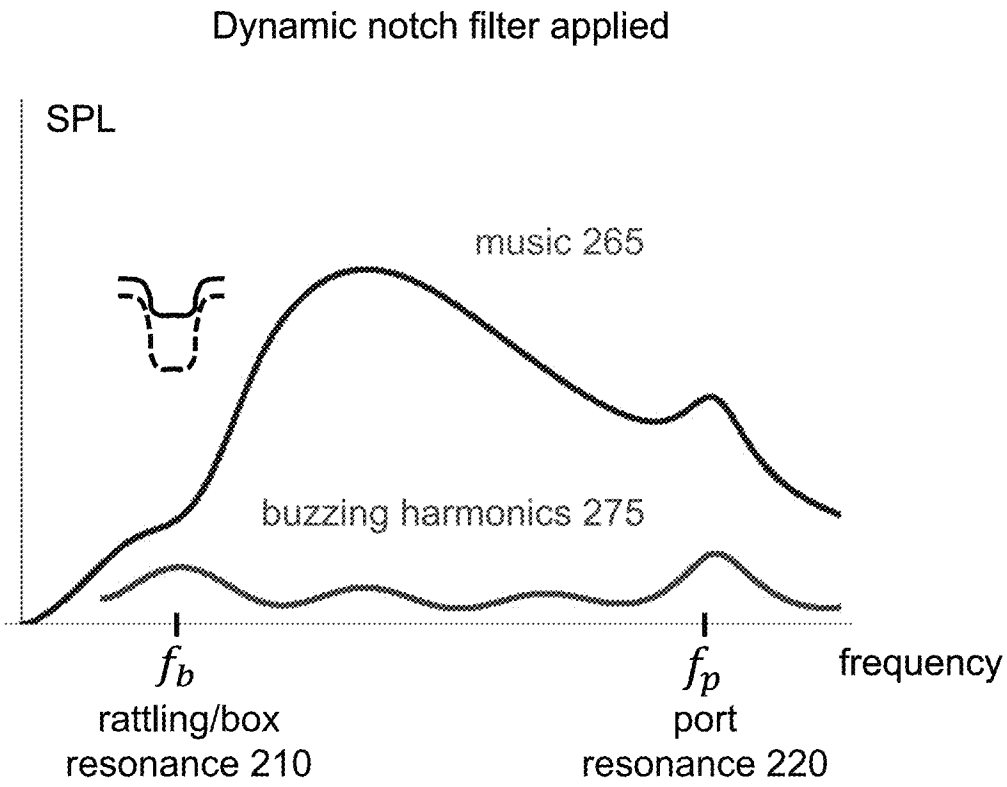
FIG. 2*d* schematically illustrates how further improvement may be achieved with a dynamic notch filter which may suppress only as much of the audio content at or near the box resonance frequency as needed to mask the buzzing with the audio content present near the port resonance frequency, according to one implementation.

In some embodiments, the strength of the notch filter may be varied depending on the results of the spectral analysis of the music signal, as illustrated in FIG. 2*d*. For example, when the spectral content of the music signal 265 is considerable at or near $f_p$, but not yet sufficient to mask the buzzing harmonics 275, the dynamic notch filter may be set to filter out only 20%, 40%, 60%, etc., or any other desired fraction of the music signal at or near $f_b$ depending on the spectral density of both the music signal 265 and the buzzing harmonics 275 at or near $f_p$, e.g. their relative strength there. In order to modify the music signal 265 as little as necessary, the strength of the dynamic notch filter may be set by the controller to be just enough to mask the buzzing harmonics 275, meaning that the masking energy of the audio content masks the acoustic energy of the buzzing. As in the embodiments described above, the spectrum analyzer may perform analysis of the music signal continuously or at discrete intervals of time, the analysis being repeated more often when it is detected that the music signal varies significantly over time and less often when it is detected that the music signal varies more gradually.

In some embodiments, instead of varying the strength of the dynamic filter, its width may be varied depending on the results of the spectral analysis of the music signal, as illustrated in FIG. 2*d*. For example, depending on the spectral content of the music signal 265 at or near $f_p$, the dynamic notch filter may be set to filter a full width of the rattling/box resonance $\Delta f_b$, a half-width, a quarter-width, or any one or more range(s) of frequencies at or near $f_b$. As in the case of a dynamic notch filter with varying strength, in order to suppress the music signal 265 as little as necessary, the width of the dynamic notch filter may be set by the controller to be just enough to mask the buzzing harmonics 275. In some embodiments, both the strength and the width of the dynamic notch filter may be varied responsive to the spectral density of both the music signal 265 and the buzzing harmonics 275 at or near $f_p$.

Figure 3:
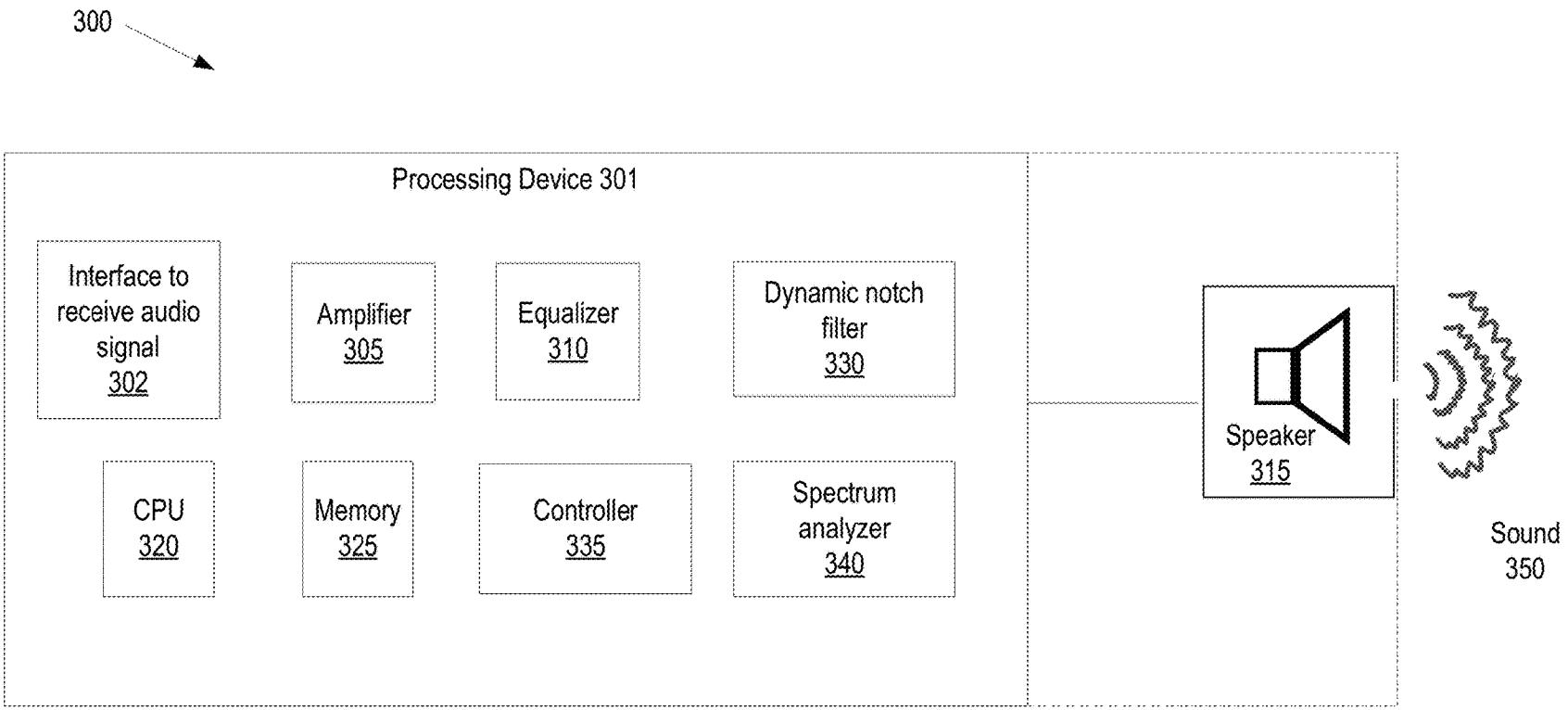
FIG. 3 illustrates components of a processing device that may be used to implement dynamic debuzzing in speakers, according to one embodiment.

FIG. 3 illustrates an exemplary embodiment of a processing device 301 of FIG. 1 that implements the debuzzer algorithm described above. The processing device 301 may be capable of processing an electric signal and providing the audio content of the electric signal to a speaker 315 to convert the audio content into a sound 350. The electric signal may represent music, voice, speech, movie soundtrack, sounds of living organisms, sounds of Nature, or any other type of an audio signal. The electric signal may be amplitude, frequency, or phase-modulated. The modulation of the electric signal may correspond to an audio content carried by the signal. The electric signal may be obtained through an interface 302 which may be connected to a radio, Wi-Fi, or any other type of an electromagnetic antenna, or a network adapter. The source of the signal may be memory 108, including, possibly, external memory (e.g. as a storage provided by cloud services), as illustrated in FIG. 1 for in some embodiments. In other implementations the signal may be derived from a memory 325 where the audio content intended for playback may also be stored. In such implementations, the electric signal may be generated upon a memory read operation executed by CPU 320. The electric signal may be analog or digital. The electric signal may be processed by amplifier 305 and equalizer 310 to modify the amplitude and the spectral properties of its audio content before providing the audio content to the dynamic notch filter 330 and, subsequently, to the speaker 315. Additionally, the audio content of the electric signal may be accessed by the spectrum analyzer 340. The spectrum analyzer 340 may analyze the amplitude and the spectral distribution of the audio content. The spectrum analyzer 340 may assess the entire frequency range of the audio content or, in some embodiments, analyze only a vicinity of the box resonance frequency $f_b$ and the port resonance frequency $f_p$. The vicinities of the aforementioned frequencies may refer to full widths of the corresponding resonances, half-widths, or any other required fractions of the full widths; the vicinities may also refer to the frequency intervals that are broader that the full widths. CPU 320 of the processing device 301 may retrieve calibration data from the memory 325 and provide the calibration data to the controller 335. The controller 335 may determine if the audio content input on the speaker 315 is likely to induce output buzzing of the speaker 315 (or of the speaker box 110/speaker box's mechanical connection to the device 105) at or near the frequency $f_p$ of the port resonance. For example, the calibration data may comprise a threshold level of spectral density of the audio content the box resonance frequency sufficient to produce buzzing of the speaker at the port resonance frequency $f_p$. The controller 335, in some embodiments in conjunction with the spectrum analyzer 340 and/or CPU 320, may then determine the optimal settings or parameters of the dynamic notch filter 330 that would decrease the amplitude of the buzzing—produced after the speaker 315 converts the input audio content into the sound 350 output by the speaker—without unnecessary distortion of the audio content. In one implementation, settings or parameters of the dynamic notch filter 330 may be fixed. In other implementations, settings or parameters of the dynamic notch filter 330 may be adjustable. For example, the controller 335 may compare the spectral density of the audio content output by the amplifier 305 and/or equalizer 310 at or near the frequency of the box resonance $f_b$ and compare it with the spectral density of the audio content at or near the port resonance frequency $f_p$. The may controller 335 may retrieve calibration data that may contain a table (or a mathematical formula, or any other type of correspondence) indexed by the value of the spectral content at or near the box resonance frequency $f_b$ and showing the minimum (threshold) value of the spectral content at or near the port resonance frequency $f_p$ that would be sufficient to mask buzzing harmonics induced by the box resonance when the latter is driven by the audio content of the signal input to the speaker 315.

If the spectral content at or near the port resonance frequency $f_p$ is above a minimum value in the calibration table, the controller 335 may not activate the dynamic notch filter 330 at all. However, if the spectral content at or near the port resonance frequency $f_p$ is below the minimum value required for masking, the controller 335 may further address the calibration data to retrieve the optimal settings or parameters of the dynamic notch filter 330, such as the strength and/or the width of the filter. In some embodiments, the optimal settings or parameters of the dynamic notch filter may be retrieved from the calibration table. In other embodiments, the optimal values of the strength and/or the width of the dynamic notch filter 330 may be encoded in the calibration data in the form of mathematical expressions. The controller 335 may provide the retrieved settings to the dynamic notch filter 330. The processing device 301 may then transmit the modified audio signal having the audio content to the speaker 315 through the dynamic notch filter 330. In some implementations, transmitting the signal through a dynamic notch filter may be equivalent to transmitting the signal through a static notch filter, if the parameters of the dynamic notch filter are fixed.

The controller 335 may activate the spectrum analyzer 340 to repeat spectral analysis of the audio content again after a predetermined time $\tau$ has elapsed. The time $\tau$ may be set in the memory 325, in one implementation. The controller 335 may provide new optimal settings to the dynamic notch filter 330 in view of the changes that occurred in the spectral density of the audio content over time $\tau$. The controller may store the spectral density data of at least two—e.g. consecutive—analyses and determine when the next analysis should be performed. For example, as explained above, if the spectral density of the audio content remains relatively constant over multiple analyses, the controller 335 may schedule the next analysis to occur after a time greater than the set time interval $\tau$ has passed. To the contrary, if the spectral density of the audio content changes considerably between subsequent analyses, the controller 335 may schedule the next analysis to occur after a time interval shorter than the set time interval $\tau$ has elapsed.

One may appreciate various implementations of the processing device 301 shown by way of illustration in FIG. 3. For example, some components included in FIG. 3 may be absent in some embodiments. For example, the amplifier 305 or equalizer 310 may be absent or, alternatively, located outside the processing device 301. The processing device 301 may have multiple CPUs 320 and/or memory 325 devices. The controller 335 may have its own CPU and/or memory (e.g. cache) or may utilize the capabilities of CPU 320 and/or memory 325 of the processing device 301. The processing device 301 may be a smartphone, a flip phone, an iPad, an iPod, a laptop computer, or any other computer or communication device having an audio speaker.

The processing device 301 may be a System-on-Chip (SoC) that integrates all or most components on the same integrated circuit. Alternatively, some or all of the components shown in FIG. 3 may be assembled using the motherboard-type architecture with different devices/components attached to the central motherboard. In some embodiments the speaker 315 may be outside the processing device 301. In other embodiments, the speaker 315 may be a part of the processing device 301, as indicated by the dashed rectangle in FIG. 3. Some of the components of the processing device 301 may be combined together. For example, amplifier 305 and equalizer 310 may be combined. In some implementations, controller 335 and/or spectrum analyzer 340 may be integrated into the dynamic notch filter 330. Some of the components shown in FIG. 3 may be analog while other components may be digital. In some embodiments, all components of the processing device 301 may be digital.

Some of the components shown in FIG. 3, for example, the controller 335 and the spectrum analyzer 340 may be purely software-implemented.

In the embodiments discussed above, the spectrum analyzer 340 analyzes the audio content before it is input to the speaker 315. This may make it necessary to map (calibrate) the (known) electrical signal input on the speaker 315 onto the (predicted) sound output (SPL) of the speaker 315. Such calibration can be performed during manufacturing and is discussed in more detail below. In other embodiments, the spectrum analyzer 340 may receive the actual SPL data as output by the speaker 315 via a special hardware device, such as a feedback microphone mounted near the port of the speaker box. In such embodiments, only a reduced amount of calibration may be needed. However, in those instances where additional hardware may be impractical, a careful calibration of the speaker input-output may significantly improve user's experience.

Figure 4:
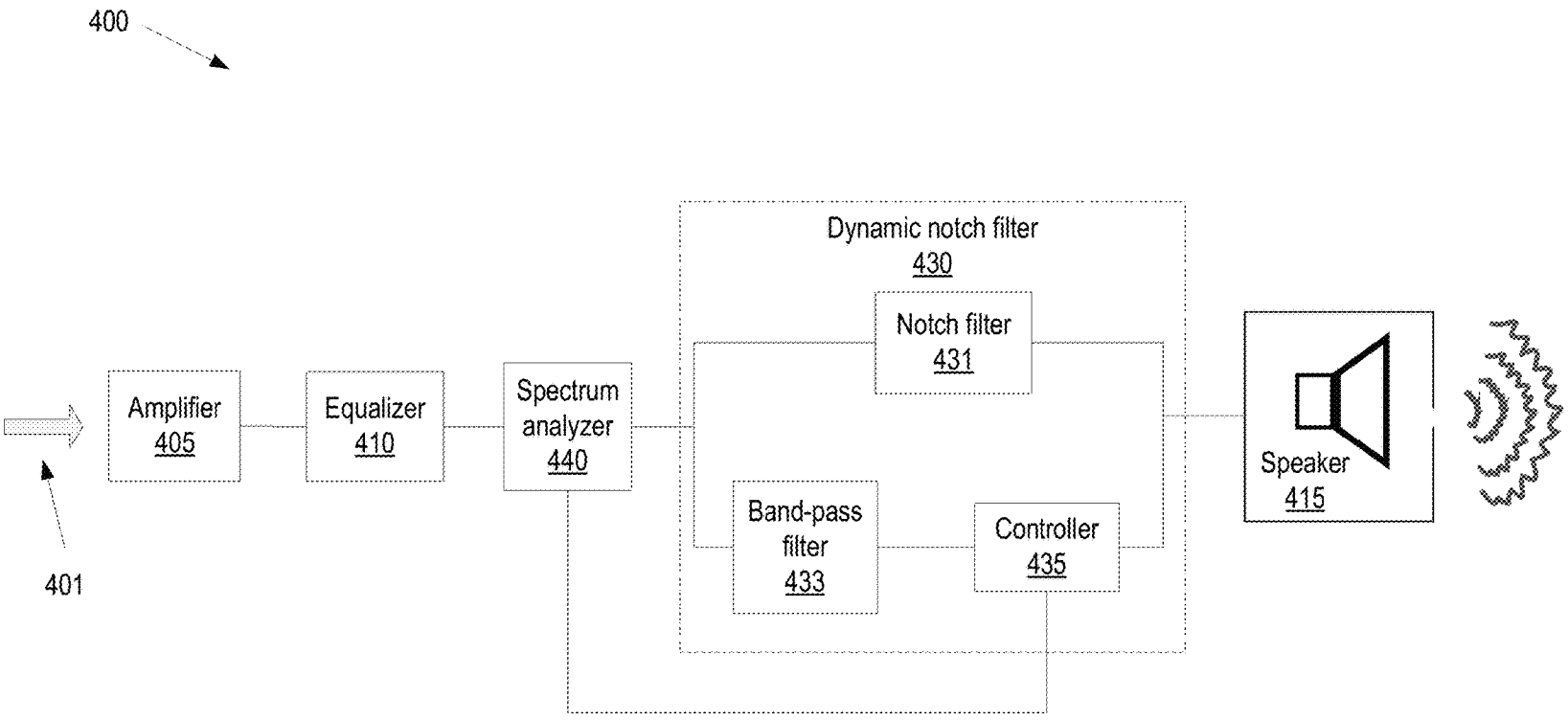
FIG. 4 illustrates one specific implementation of a functional relationship of the components of a processing device that may be used to implement dynamic debuzzing in speakers.

FIG. 4 illustrates one possible functional relationship 400 between different components of the debuzzer shown previously in FIG. 3. By way of example and not of limitation, the electric signal 401 received by an antenna or a network adapter may be processed by the amplifier 405 and equalizer 410 and input to the spectrum analyzer 440 before being delivered to the dynamic notch filter 430. The dynamic notch filter 430 may comprise a static notch filter 431, a band-pass filter 433 connected in parallel to the static notch filter 431, and the controller 435 connected in series with the band-pass filter 433. In the implementation shown in FIG. 4, the static notch filter may receive a first copy of the audio signal and the band-pass filter may receive a second copy of the audio signal. The first copy and the second copy may be identical. The static notch filter may be configured to eliminate completely (or almost completely) all input frequencies within a given frequency interval of at or near the frequency of the box resonance $f_p$. The band-pass filter may be configured to pass only input frequencies within the same frequency interval $\delta f$. Accordingly, when a signal input to the dynamic notch filter 430 has frequency outside the interval $\delta f$, the band-pass filter 433 completely closes to the input signal the lower path regardless of the state of the controller 435. At the same time, the input signal reaches the speaker 415 unobstructed through the upper path containing the static notch filter 431 which does not affect frequencies outside the interval $\delta f$. On the other hand, when the input signal happens to be inside the interval $\delta f$, the static notch filter 431 may close the upper path off. In order to reach the speaker 415, the signal, therefore, must follow the lower path. Because the band-pass filter 433 is completely (or almost completely) transparent to signals within $\delta f$, the fraction of the input signal that reaches the speaker 415 may be determined by the controller 435. In the simplest implementation, the controller 435 may be a circuit element with variable impedance (e.g. a variable resistor, capacitor, or inductor, or a combination thereof). In some embodiments, it may be advantageous to configure the controller 435 to have reactive part of the impedance close to zero in order not to change the phase of the input signal.

The controller 435 may be communicating with the spectrum analyzer 440, as explained above in relation to FIG. 3. The controller 435 may obtain data (continuously or at predetermined times) from the spectrum analyzer 440. In the simplest scenario, the controller 435 may receive information about the audio content of the input signal at two frequencies—the frequency of the box resonance $f_b$ and the frequency of the port resonance $f_p$. The controller 435 may then retrieve the calibration data from the system memory 325, as explained above in relation to FIG. 3, and determine the optimal value of the variable impedance of the controller 435 to limit the input signal at or near the frequency of the box resonance $f_b$ to an extent necessary to reduce the buzzing harmonics (induced by such input signal) at or near the frequency of the port resonance $f_p$ to just below the threshold of the user's hearing, the threshold being a function of the projected audio content at the frequency of the box resonance $f_b$ and the frequency of the port resonance $f_p$. FIG. 4 illustrates merely one possible exemplary implementation of the debuzzer based on a dynamic notch filter, but numerous other implementations are possible to limit the buzzing harmonics at high frequencies by notching out the audio content at low frequencies using the general inventive concepts explained above. For example, controller 435 may contain a limiter with adjustable parameters. The controller 435 may have analog components or may be purely digital. The controller 435 may be implemented as a separate hardware component, in some embodiments. In other implementations, however, controller 435 may be software-implemented by CPU 320 based on instructions retrieved from memory 325 without any additional hardware components. In some embodiments, the signal filtered by the static notch filter 431 and the signal transmitted through the band-pass filter 433 and controller 435 may be added in an adder (not explicitly illustrated in FIG. 4) before the modified audio signal is provided to the speaker 415.

Figure 5:
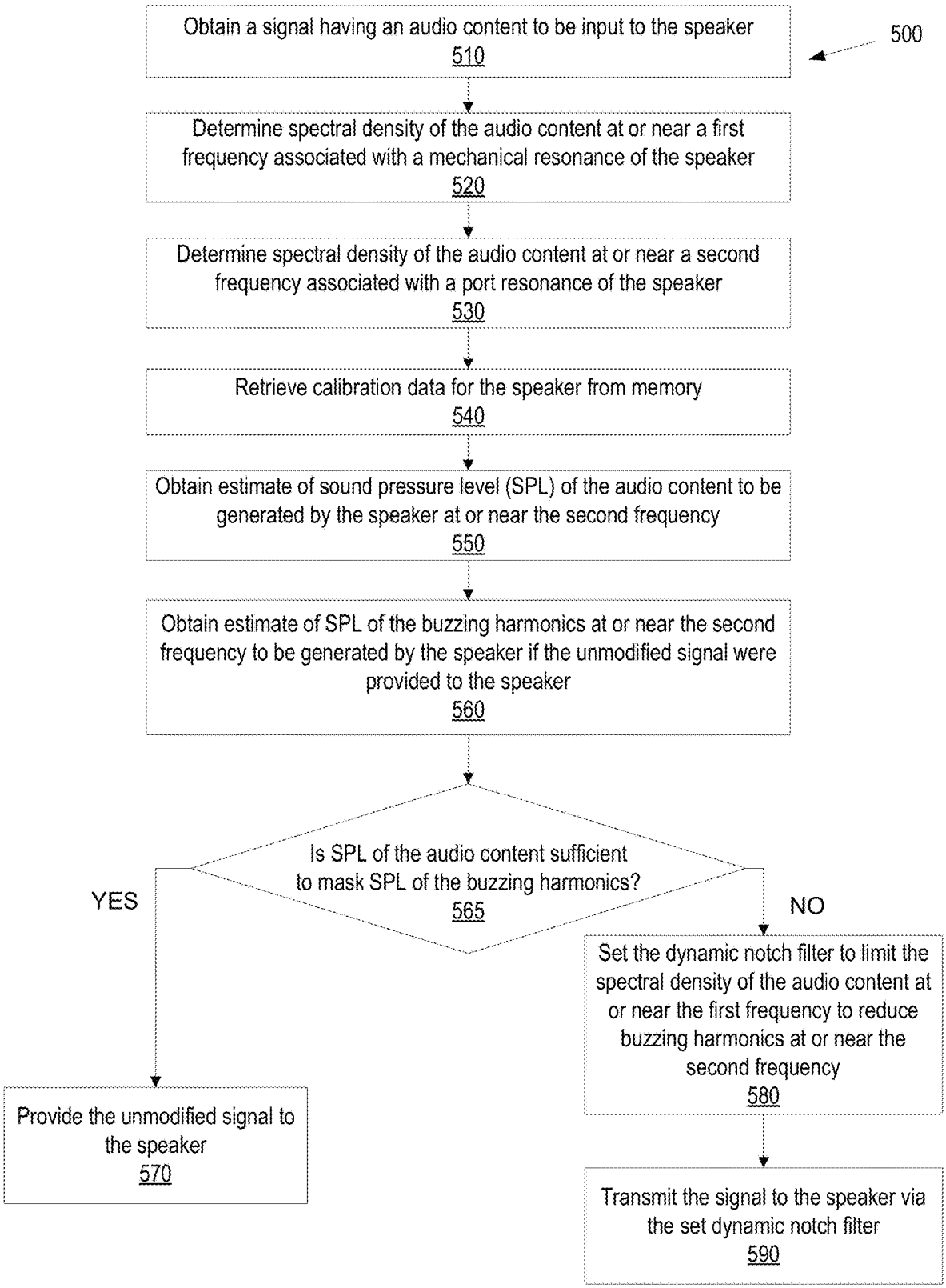
FIG. 5 illustrates steps of a process that may be used to implement dynamic debuzzing in speakers using previously stored calibration data, according to one embodiment.

FIG. 5 illustrates possible steps of the process 500 to prevent amplified buzzing in speakers which can be implemented with systems illustrated in FIGS. 3-4. In some embodiments, the process 500 may be performed without a reference to any specific components shown in FIGS. 3-4. At step 505, a signal—e.g. electric signal—may be obtained through radio, Wi-Fi, or any other type of electromagnetic reception, or through a network, or generated upon a read operation from a memory. The signal may be analog or digital. The signal may have an audio content such as music, voice, speech, movie soundtrack, or any other type of an audio signal. For example, the signal may be a high (radio) frequency carrier modulated to have a low frequency audio content. In some implementations, the audio content may be encoded in a purely digital form and not utilize any high-frequency carrier. The audio content may be intended to be converted into sound waves by the speaker. The signal may be amplified, filtered, processed in some other way, so that its audio content may be modified before it is to be provided to the speaker.

At step 520 the spectral density of the audio content of the signal may be analyzed. For example, a spectral density of the audio content at or near a first frequency $f_b$ may be determined, the first frequency $f_b$ being associated with a mechanical resonance of the speaker. The mechanical resonance may refer to any mechanical motion (rattling) of any component of the speaker, such as a diaphragm (membrane), or any components of the speaker assembly, such as the sides of the speaker housing, or any mechanical motion of the speaker/speaker assembly relative to the environment, such as a body of a phone or any other electronic device. The term "at or near" the frequency of the mechanical resonance may refer to the full width of the resonance, the half-width, or any other desired fractions of the full width; the term "at or near" may also refer to the frequency intervals that are broader that the full widths.

At step 530 a spectral density of the audio content at or near a second frequency $f_p$ may be similarly determined, the second frequency $f_p$ being associated with an acoustic port resonance of the opening (port) of the speaker. The spectral densities may be extracted using spectral (Fourier) analysis of the audio content. The spectral analysis may be performed using hardware components, or a combination of hardware components and software resources, or may be performed using software only. The frequencies of the first mechanical rattling resonance $f_b$ and the second acoustic port resonance $f_p$ may be previously known, e.g. via a calibration process performed during manufacturing.

At step 540 a speaker calibration data may be retrieved. The calibration data may be stored in a memory device, which may be local to the device hosting the speaker. In some embodiments, the calibration data may be remotely stored using cloud services accessible via a network. The calibration data may represent the outcome of multiple measurements performed on the same speaker or others speakers of the same type. In some embodiments, at steps 550-560, the calibration data may provide estimates of what SPL output of the speakers is likely to be if the instant audio content with the given spectral density is input to the speakers. For example, at step 550 the calibration data may be used to estimate SPL of the audio content of the instant signal to be generated by the speaker at or near the port resonance frequency $f_p$. Similarly, at step 560 the calibration data may be used to estimate SPL of the buzzing harmonics at or near the port frequency $f_p$ that would be induced in the speaker box if the unmodified signal were provided to the speaker. At step 565, an assessment may be performed to determine if the existing audio content is sufficiently strong to mask the buzzing/rattling at $f_p$. If the calibration data indicate so, step 570 may be executed and the instant signal may be provided to the speaker without any modifications to its audio content. For example, at step 570 the dynamic notch filter may be bypassed or not activated (e.g. the filter may remain in the "off" state).

In contrast, when the calibration data indicate that the spectral density of the audio content at or near the port resonance frequency $f_p$ is too weak to mask the buzzing/rattling induced by the spectral density of the audio content at or near the box resonance frequency $f_b$, a decision may be made at step 565 to activate the dynamic notch filter. The dynamic notch filter may then limit the audio content at or near the box resonance frequency $f_b$, to an extent sufficient to ensure that the buzzing harmonics at the port resonance frequency $f_p$ may not be discerned by the user from the background of the audio playback. Accordingly, at step 580 a processing device may retrieve, from the calibration data, the settings or parameters of the dynamic notch filter needed to mask the buzzing for the instant signal given the spectral density of its audio content at or near the box resonance frequency $f_b$ and the port resonance frequency $f_p$. At step 590, the signal may be provided to the speakers through the dynamic notch filter which is configured with the adjustable settings or parameters obtained from the calibration data as a function of the masking energy present around the frequency of the port resonance.

In some embodiments, the optimal settings or parameters of the dynamics notch filter may be minimal, just enough to mask the buzzing but still limiting the audio content at $f_b$ as little as possible. In other embodiments, a more aggressive limiting may be implemented to decrease the likelihood that a later change in the audio content will make the limiting insufficient. The process 500 may be repeated after a predetermined time $\tau$, with new optimal settings or parameters for the dynamic notch filter re-determined in view of the changes that have occurred in the spectral density of the audio content over time $\tau$. The spectral density data of multiple steps 520 and 530 of consecutive spectral analyses may be stored in the memory and used to determine when the next analysis should be performed. For example, if the spectral densities of the audio content remain relatively constant over multiple analyses, the repeat of the process 500 may be scheduled after a time greater than time $\tau$ has passed. In contrast, if the spectral densities of the audio content change significantly over the recent multiple analyses, the next execution of the process 500 may be set to occur sooner than after the time interval $\tau$ has elapsed.

Figure 6:
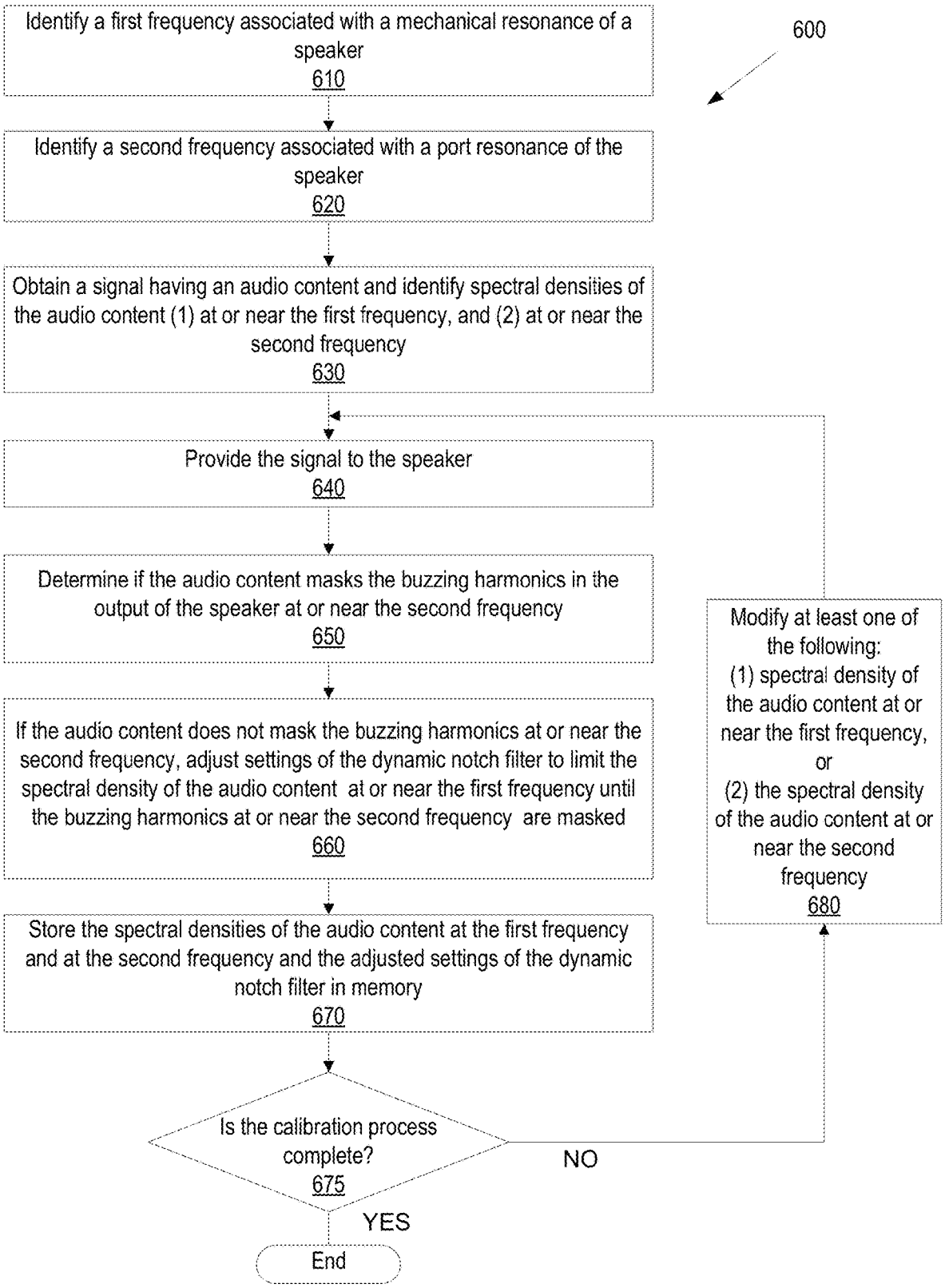
FIG. 6 illustrates steps of a process that may be used to create calibration data for the use in dynamic debuzzing process of FIG. 5, according to one embodiment.

FIG. 6 illustrates one possible embodiment of a calibration process 600 that may be performed during manufacturing. For example, such calibration process may be performed after the speaker is manufactured and assembled into a device (such as a phone) but before the dynamic notch filter's hardware and/or software is installed in the device. The calibration process 600 may be performed after the physical components of the speaker, speaker box/assembly are put in place. At step 610, a first frequency $f_b$ associated with the mechanical (box) resonance of the speaker/speaker assembly may be identified. For example, the speaker may be subjected to a harmonic monochromatic electric signal and its electromagnetic impedance measured as a function of the frequency of this harmonic signal. Alternatively, a sound pressure level produced by the speaker in response to such harmonic electric signal may be measured instead. Such box resonance may be identified at relatively low frequencies $f_b \approx 0.1\text{-}1.5$ KHz depending on the geometry/size of the speaker/speaker assembly, although lower or higher frequencies $f_b$ may also be realized. At step 620, a second frequency $f_p$ associated with the acoustic (port) resonance of the speaker box opening may be identified. The port resonance $f_p$ may be identified at substantially higher frequencies of the order of a few KHz depending on the geometry of the port and the speaker/speaker assembly, although higher frequencies $f_p$ of about 10 KHz or even more may be identified, e.g. for smaller ports.

At step 630, a test/calibration signal may be prepared. The calibration signal may have audio content with the desired spectral densities at or near the frequencies of the box resonance $f_b$ and the port resonance $f_p$. In one simple embodiment, only two spectral densities may be identified whereas non-resonant frequencies may be disregarded. In more sophisticated calibration processes, spectral densities at more than two frequencies may be controlled. In some embodiments, the calibration signal's audio input may be controlled for multiple (or even quasi-continuous) control frequencies. In what follows, the calibration process with two parameters—spectral densities at $f_b$ and $f_p$ is described for simplicity, but a multi-parameter calibration process should be regarded as a straightforward generalization.

At step 640 the calibration signal is provided to the speaker. At step 650 it is determined whether the spectral density of the audio content at $f_p$ is sufficient to mask the buzzing harmonics induced by the audio content at $f_b$. If it is detected that the masking is sufficient, it may be recorded in the calibration data that no further dynamic or static notching is required. In some instances detection may be facilitated by a human operator directly listening to the buzzing. In other instances detection may be performed solely by software or hardware simulating human hearing or a combination thereof. If it is determined at step 650 that inadequate masking occurs, the dynamic notch filter's settings or parameters (e.g. strength, width, etc.) may be adjusted at step 660 and the spectral density of the audio content at $f_b$ may be limited until buzzing at $f_p$ can no longer be discerned. Once satisfactory masking has been achieved, the dynamic notch filter's settings or parameters may be stored in the memory as calibration data together with the spectral densities at the control frequencies (e.g. $f_b$ and $f_p$). The calibration data may be stored in a table indexed by the spectral density at the frequency of the mechanical box resonance $f_b$. Alternatively, he calibration data may be stored in a table indexed by the spectral density at the frequency of the acoustic port resonance $f_p$.

If it is determined that the calibration process is incomplete, a decision may be made at step 675 to continue calibration. At step 680, a new signal may be generated which differs from the last signal (or from all previous signals) in the magnitude of at least one of the spectral densities at control frequencies, such as $f_b$ and $f_p$, in a simplest embodiment. Steps 640, 650, 660, and 670 may then be repeated. In some embodiments, there may be $n \geq 2$ control frequencies and for each frequency m different spectral densities (e.g. increasing linearly or logarithmically) may be prepared for the total number of $n^m$ different calibration signals to be used within the course of the calibration process.

It should be understood that the above description is intended to be illustrative, and not restrictive. Many other implementation examples will be apparent to those of skill in the art upon reading and understanding the above description. Although the present disclosure describes specific examples, it will be recognized that the systems and methods of the present disclosure are not limited to the examples described herein, but may be practiced with modifications within the scope of the appended claims. Accordingly, the specification and drawings are to be regarded in an illustrative sense rather than a restrictive sense. The scope of the present disclosure should, therefore, be determined with reference to the appended claims, along with the full scope of equivalents to which such claims are entitled.

The implementations of methods, hardware, software, firmware or code set forth above may be implemented via instructions or code stored on a machine-accessible, machine readable, computer accessible, or computer readable medium which are executable by a processing element. "Memory" includes any mechanism that provides (i.e., stores and/or transmits) information in a form readable by a machine, such as a computer or electronic system. For example, "memory" includes random-access memory (RAM), such as static RAM (SRAM) or dynamic RAM (DRAM); ROM; magnetic or optical storage medium; flash memory devices; electrical storage devices; optical storage devices; acoustical storage devices, and any type of tangible machine-readable medium suitable for storing or transmitting electronic instructions or information in a form readable by a machine (e.g., a computer).

Reference throughout this specification to "one implementation" or "an implementation" means that a particular feature, structure, or characteristic described in connection with the implementation is included in at least one implementation of the disclosure. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations.

In the foregoing specification, a detailed description has been given with reference to specific exemplary implementations. It will, however, be evident that various modifications and changes may be made thereto without departing from the broader spirit and scope of the disclosure as set forth in the appended claims. The specification and drawings are, accordingly, to be regarded in an illustrative sense rather than a restrictive sense. Furthermore, the foregoing use of implementation, embodiment, and/or other exemplarily language does not necessarily refer to the same implementation or the same example, but may refer to different and distinct implementations, as well as potentially the same implementation.

The words "example" or "exemplary" are used herein to mean serving as an example, instance or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such. Also, the terms "first," "second," "third," "fourth," etc. as used herein are meant as labels to distinguish among different elements and may not necessarily have an ordinal meaning according to their numerical designation.

What is claimed is:

1. An apparatus comprising:

a speaker enclosed in a speaker assembly, the speaker assembly having a port;

a processing device coupled to the speaker, wherein the processing device is configured to execute a dynamic algorithm to attenuate audio distortions of an audio signal that are amplified by a port resonance of the port, the dynamic algorithm to:

receive the audio signal, the audio signal having an audio content;

determine a first value representing spectral density of the audio content at a first resonance frequency, wherein the first resonance frequency is associated with a mechanical motion of (i) a speaker diaphragm or (ii) a mechanical support of the speaker diaphragm, wherein the first resonance frequency is lower than a second resonance frequency, wherein the second resonance frequency is associated with the port resonance of the port;

attenuate the audio distortions by limiting spectral density of the audio content at the first resonance frequency to produce a modified audio signal; and output the modified audio signal to the speaker.

2. The apparatus of claim 1, wherein, to attenuate the audio distortions, the dynamic algorithm is to apply a static notch filter at the first resonance frequency, wherein the static notch filter has fixed parameters.

3. The apparatus of claim 1, wherein, to attenuate the audio distortions, the dynamic algorithm is to apply a dynamic notch filter at the first resonance frequency, wherein the dynamic notch filter has adjustable parameters, wherein the adjustable parameters are set as a function of masking energy present around the second resonance frequency of the port resonance of the port.

4. The apparatus of claim 1, wherein the speaker assembly is a side-firing speaker box with the port on a side of the side-firing speaker box, the speaker is a side-firing speaker disposed on an adjacent side of the side with the port, and wherein at least one of a length or a width of the port corresponds to an integer number of half-wavelengths of sound associated with the second resonant frequency.

5. The apparatus of claim 1, wherein limiting spectral density of the audio content at the first resonance frequency comprises reducing spectral density of the audio content in at least one range of frequencies within a full width of the first resonance frequency.

6. The apparatus of claim 1, wherein the first resonance frequency is in a range between approximately 300 Hz and 1.5 kHz.

7. The apparatus of claim 1, wherein the speaker is a microspeaker comprising a sound-producing membrane, wherein the sound-producing membrane has a perimeter of less than 5 inches.

8. An apparatus comprising, a source to generate a signal having an audio content;

a spectrum analyzer to determine a first value representing spectral density of the audio content at a first resonance frequency, wherein the first resonance frequency is associated with a mechanical motion of (i) a speaker diaphragm or (ii) a mechanical support of the speaker diaphragm, the spectrum analyzer is further to determine a second value representing spectral density of the audio content at a second resonance frequency, wherein the second resonance frequency is associated with a port of a speaker assembly; and a notch filter to modify the signal by limiting spectral density of the audio content at the first resonance frequency in view of the first value and the second value.

9. The apparatus of claim 8 further comprising a memory device to store speaker calibration data, the speaker calibration data comprising a threshold level of spectral density of the audio content at the first resonance frequency that is sufficient to mask buzzing of the speaker assembly at the second resonance frequency.

10. The apparatus of claim 9, wherein the notch filter is a dynamic notch filter having adjustable parameters, the apparatus further comprising a controller to modify the adjustable parameters of the dynamic notch filter in response to the first value, the second value, and the speaker calibration data.

11. The apparatus of claim 10, wherein the adjustable parameters of the dynamic notch filter comprise a strength of the dynamic notch filter.

12. The apparatus of claim 11, wherein the adjustable parameters of the notch filter comprise a width of the dynamic notch filter.

13. A method to reduce buzzing in a speaker, the method comprising:

obtaining a signal having an audio content;

determining a first value representing spectral density of the audio content at a first resonance frequency, wherein the first resonance frequency is associated with a mechanical motion of (i) a speaker diaphragm or (ii) a mechanical support of the speaker diaphragm;

determining a second value representing spectral density of the audio content at a second resonance frequency, wherein the second resonance frequency is associated with a port of a speaker assembly;

determining, responsive to the first value and the second value, that the signal is to produce buzzing of the speaker at the second resonance frequency;

producing a modified signal by limiting spectral density of the audio content at the first resonance frequency to a degree determined responsive to the first value and the second value; and providing the modified signal to the speaker.

14. The method of claim 13, wherein determining that the signal is to produce buzzing comprises retrieving speaker calibration data from memory, the speaker calibration data comprising a threshold level of spectral density of the audio content at the first resonance frequency sufficient to produce buzzing of the speaker at the second resonance frequency.

15. The method of claim 13, wherein producing the modified signal comprises transmitting the signal through a static notch filter.

16. The method of claim 13, wherein producing the modified signal comprises transmitting the signal through a dynamic notch filter having adjustable parameters.

17. The method of claim 16, wherein the adjustable parameters comprises a strength of the dynamic notch filter, and wherein producing the modified signal further comprises adjusting the strength of the dynamic notch filter responsive to the first value, the second value, and a speaker calibration data.

18. The method of claim 17 wherein the adjustable parameters comprise a width of the dynamic notch filter, and wherein producing the modified signal further comprises adjusting the width of the dynamic notch filter responsive to the first value, the second value, and the speaker calibration data.

19. The method of claim 13 wherein determining the first value and the second value is repeated after a set time interval.

20. The method of claim 13 wherein limiting spectral density of the audio content at the first resonance frequency comprises reducing spectral density in at least one range of frequencies within a full width of the first resonance frequency.

* * * * *